US012492606B1

(12) United States Patent
Harper et al.

(10) Patent No.: US 12,492,606 B1
(45) Date of Patent: Dec. 9, 2025

(54) FIBER OPTIC MONITORING IN CHEMICAL INJECTION AND GAS LIFT SYSTEMS

(71) Applicant: Baker Hughes Oilfield Operations LLC, Houston, TX (US)

(72) Inventors: Jason Harper, Cypress, TX (US); Thomas McClain Scott, Cypress, TX (US); Zhi Yong He, Cypress, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/812,558

(22) Filed: Aug. 22, 2024

(51) Int. Cl.
*E21B 33/072* (2006.01)
*E21B 23/03* (2006.01)
*E21B 43/12* (2006.01)

(52) U.S. Cl.
CPC ..... *E21B 33/072* (2013.01); *E21B 23/03* (2013.01); *E21B 43/122* (2013.01)

(58) Field of Classification Search
CPC .... E21B 17/025; E21B 17/026; E21B 17/028; E21B 23/03; E21B 23/08; E21B 23/10; E21B 33/072; E21B 34/10; E21B 43/122
See application file for complete search history.

(56) References Cited

U.S. PATENT DOCUMENTS 3,602,304 A * 8/1971 Mallinger ..... E21B 43/263 174/21 R
4,200,297 A * 4/1980 Tricon ..... E21B 17/025 175/320
4,524,834 A * 6/1985 Barron ..... E21B 17/025 277/330

(Continued)

FOREIGN PATENT DOCUMENTS

AU 776876 B2 9/2004
GB 2412673 A * 10/2005 ..... E21B 47/135

OTHER PUBLICATIONS

Brown et al., "Slickline With Fiber-Optic Distributed Temperature Monitoring for Water-Injection and Gas Lift Systems Optimization in Mexico," SPE Latin American and Caribbean Petroleum Engineering Conference, Jun. 20, 2005.

(Continued)

*Primary Examiner* — Jennifer H Gay

(74) *Attorney, Agent, or Firm* — Baker Hughes Patent Organization

(57) ABSTRACT

A wellhead, including a fluid injection system disposed in the wellhead, a fiber injection system disposed in the wellhead and operably connected to the fluid injection system to inject fiber into the fluid injection system. A multimodal fluid injection valve, including a body having a check valve therein, a side pocket physically and fluidly connected to the body, the side pocket including a fiber anchor therein. A method for instrumenting a preexisting gas lift or chemical injection system, including cleaning the chemical injection system, and injecting optic fiber through the chemical injection system. A wellbore system including a borehole in a subsurface formation, a string in the borehole, a surface system operably connecting both a chemical or gas injection device and an optic fiber injection device to a gas lift or chemical injection subsystem in the borehole, and an optic fiber disposed in the chemical or gas injection subsystem.

9 Claims, 5 Drawing Sheets

(56) References Cited

U.S. PATENT DOCUMENTS 4,681,162 A * 7/1987 Boyd ..... E21B 17/025 166/242.5
4,825,946 A * 5/1989 Schnatzmeyer ..... H01R 13/523 166/66
4,928,522 A * 5/1990 Tonnelli ..... E21B 47/11 166/252.6
5,419,399 A * 5/1995 Smith ..... E21B 17/06 166/377
5,435,395 A * 7/1995 Connell ..... E21B 23/14 166/77.2
RE37,283 E * 7/2001 Kluth ..... E21B 47/135 385/100
6,913,083 B2 7/2005 Smith
7,021,388 B2 4/2006 Williams
7,131,497 B2 * 11/2006 Helms ..... E21B 17/025 166/381
7,322,421 B2 * 1/2008 Blacklaw ..... E21B 23/10 166/383
7,503,395 B2 * 3/2009 Meijer ..... E21B 17/023 166/380
7,503,397 B2 * 3/2009 Giroux ..... E21B 7/20 166/241.5
7,575,061 B2 * 8/2009 Angman ..... E21B 23/14 166/241.5
7,594,763 B2 * 9/2009 Richards ..... G01V 1/52 166/385
8,418,771 B2 * 4/2013 Sach ..... E21B 29/04 166/242.6
8,424,595 B2 * 4/2013 Sach ..... E21B 17/06 166/54.5
9,291,789 B2 * 3/2016 Michaelis ..... E21B 41/00
9,598,926 B2 * 3/2017 Taylor ..... H02G 1/086
9,835,001 B2 * 12/2017 Watt ..... E21B 43/2406
10,301,912 B2 * 5/2019 De Witt ..... B08B 7/0042
10,533,381 B2 * 1/2020 Head ..... E21B 17/028
11,162,306 B2 * 11/2021 Simonsen ..... E21B 17/028
11,708,749 B2 7/2023 Kleppa
11,851,990 B2 * 12/2023 Hogstead ..... E21B 17/028
12,209,471 B2 * 1/2025 Haugland ..... E21B 33/072
2005/0109518 A1 * 5/2005 Blacklaw ..... E21B 23/08 166/383
2005/0211443 A1 * 9/2005 Helms ..... E21B 17/025 166/380
2006/0032638 A1 * 2/2006 Giroux ..... E21B 7/20 166/377
2006/0260817 A1 * 11/2006 Meijer ..... E21B 17/023 166/242.6
2007/0056722 A1 * 3/2007 Angman ..... E21B 23/14 166/50
2008/0179063 A1 7/2008 Smith
2011/0024133 A1 * 2/2011 Sach ..... E21B 17/06 166/77.51
2015/0378124 A1 * 12/2015 Michaelis ..... E21B 47/002 385/134
2016/0251940 A1 * 9/2016 De Witt ..... E21B 7/14 166/304
2016/0356113 A1 * 12/2016 Taylor ..... E21B 17/206
2018/0066479 A1 * 3/2018 Head ..... E21B 43/128
2018/0202281 A1 * 7/2018 LeBlanc ..... E21B 47/005
2021/0032940 A1 * 2/2021 Simonsen ..... E21B 17/028
2022/0010641 A1 * 1/2022 Haugland ..... E21B 37/00
2022/0282594 A1 * 9/2022 Hogstead ..... E21B 17/028
2025/0012185 A1 * 1/2025 Penno ..... E21B 23/03
2025/0101810 A1 * 3/2025 Rowcliffe ..... E21B 47/12

OTHER PUBLICATIONS

Ninalow, Ibrahim, "Hydrate Prevention Strategy and the Associated Cost in the Gulf of Mexico"; Heriot Watt University, Institute of Petroleum Engineering, Aug. 4, 2023, 43 pages.
Weaver et al., "Installation and Application of Permanent Downhole Optical Pressure/Temperature Gauges and Distributed Temperature Sensing in Producing Deepwater Wells at Marco Polo"; SPE Annual Technical Conference and Exhibition, Oct. 9, 2005.

* cited by examiner

FIBER OPTIC MONITORING IN CHEMICAL INJECTION AND GAS LIFT SYSTEMS

BACKGROUND

In the resource recovery and fluid sequestration industries it is often desirable to increase the availability of sensory information. This can be accomplished by adding optical fibers to equipment before deployment into a subsurface environment and such systems significantly valuable information. Wells constructed without such optical fibers often lack such information. With efficiency being paramount and sensory information directly related to efficiency, the art is always receptive to innovations that improve both.

SUMMARY

An embodiment of a wellhead, including a wellhead housing, a fluid injection system disposed in the wellhead housing, a fiber injection system disposed in the wellhead housing and operably connected to the fluid injection system to inject fiber into the fluid injection system.

An embodiment of a multimodal fluid injection valve, including a body having a check valve therein, a side pocket physically and fluidly connected to the body, the side pocket including a fiber anchor therein.

An embodiment of a method for instrumenting a preexisting gas lift or chemical injection system, including cleaning the chemical injection system, and injecting optic fiber through the chemical injection system.

An embodiment of a wellbore system including a borehole in a subsurface formation, a string in the borehole, a surface system operably connecting both a chemical or gas injection device and an optic fiber injection device to a gas lift or chemical injection subsystem in the borehole, and an optic fiber disposed in the chemical or gas injection subsystem.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
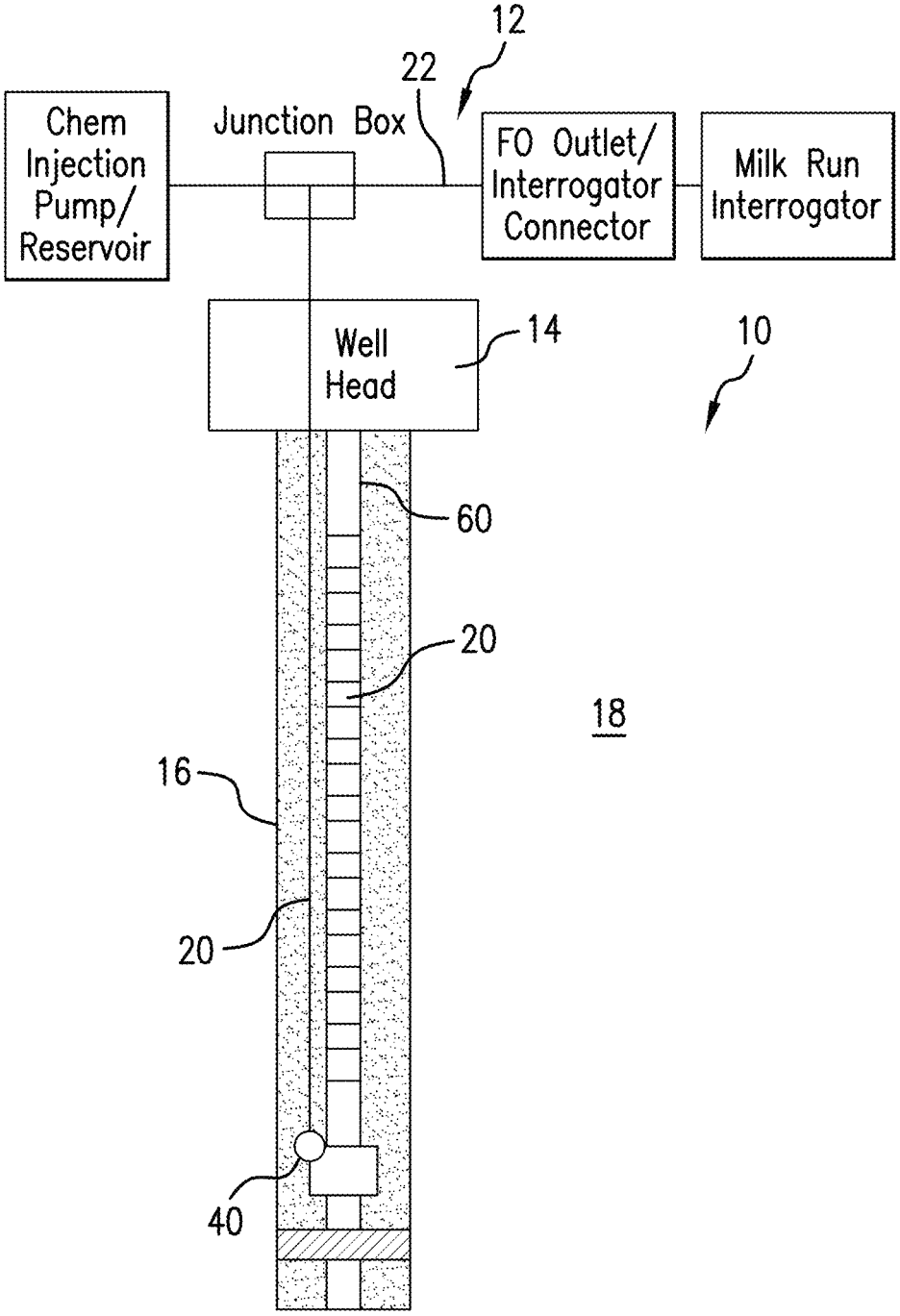
FIG. 1 is a schematic view of a wellbore system including elements disclosed herein.

Referring to FIG. 1, disclosed herein is a system 10 providing for sensory instrumentation of a chemical injection system or a gas lift system whether that system is being newly run or is a retrofit for an existing chemical injection system or gas lift system. The system includes a surface assembly 12 that may be part of a wellhead 14 or separate therefrom. Extending from the wellhead 14 is a borehole 16 penetrating a subsurface formation 18. A chemical or gas injection subsystem 20 may be in the borehole 16. Subsystem 20 includes a control line 22 that is configured to convey chemicals or gas lift fluid and in accordance with the present disclosure also an optical fiber 24. It is important to note that when addressing an optical fiber herein, this may include a single bare fiber, a plurality of fibers whether bare or in a sheath, and one or more fibers that are predisposed in a smaller control line. For example, it is contemplated herein that one or more optic fibers may be placed within a ⅛ inch (⅛ inch control line will fit inside a ¼ inch control line but other dimensions for the smaller line that will physically fit in a larger line similarly to the ⅛ inch line inside the ¼ inch line are contemplated) control line at a factory location or otherwise at some location priori to the activities discussed in this application. Then that fiber, already in the ⅛ inch control line may be injected into the gas or chemical injection subsystem 20 (which may have a ¼ inch or ⅜ inch control line) as discussed herein. For clarity, any reference to the fiber in this application should be considered to mean a single bare fiber, a plurality of fibers whether bare or in a sheath, and one or more fibers that are predisposed in a smaller control line

DETAILED DESCRIPTION

Figure 2:
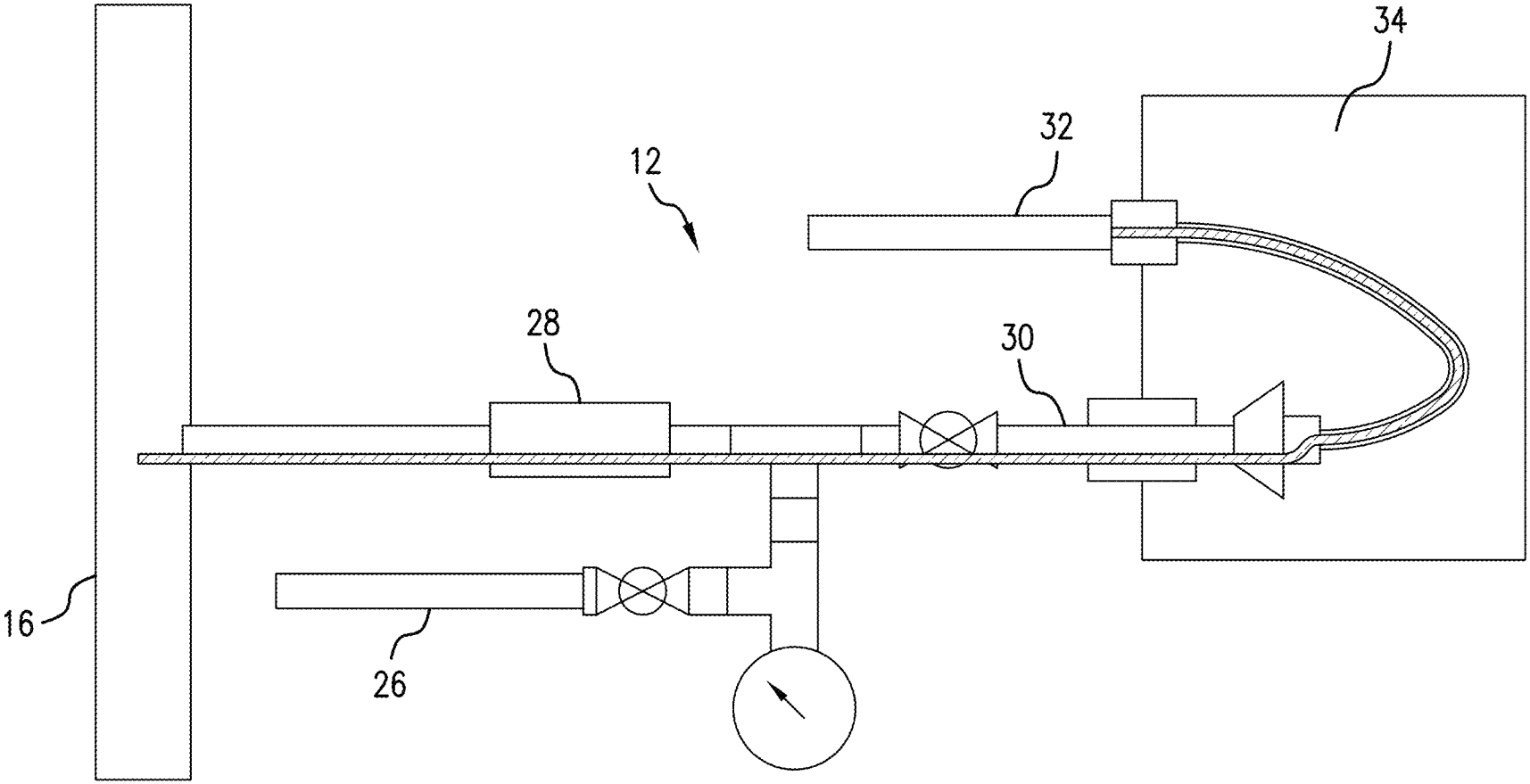
FIG. 2 is a schematic view of a surface system from FIG. 1 illustrated in greater detail.

Referring to FIG. 2, surface system 12 is illustrated in greater detail. System 12 includes a gas lift or chemical source 26 that is ported to a control line injector 28. Injector 28 is configured to inject a control line 22 into the borehole 16. The gas or chemical source 26 is conventional but the system 12 further includes a fiber header 30 operably connected to the injector 28 and a fiber supply 32 for supplying optic fiber 24 to the header 30 and into the control line 22 while containing pressure in the control line 22, and a fiber injection system 34. Header 30 is commercially available from many sources and hence requires no specific description. Accordingly, the system 12 is configured to inject fiber 24 into a contemporaneously injected control line 22 or a previously injected control line 22. It should be noted that if the optic fiber 24 is to be injected into a previously installed control line 22, it may be desirable to first inject therethrough a commercially available cleaning solution to remove any accretions inside the control line 22 that might interfere with the fiber 24. Regardless of whether the fiber injection is of a previously installed system or a new system, the fiber 24 disposed in the control line 22 provides a sensory function not heretofore available in the gas lift or chemical injection subsystems of the prior art. Where the injection of fiber 24 occurs in a previously installed subsystem, this means that the system is effectively updated to an instrumented system without substantial cost, leading to improved efficiency for the particular well.

Figure 3:
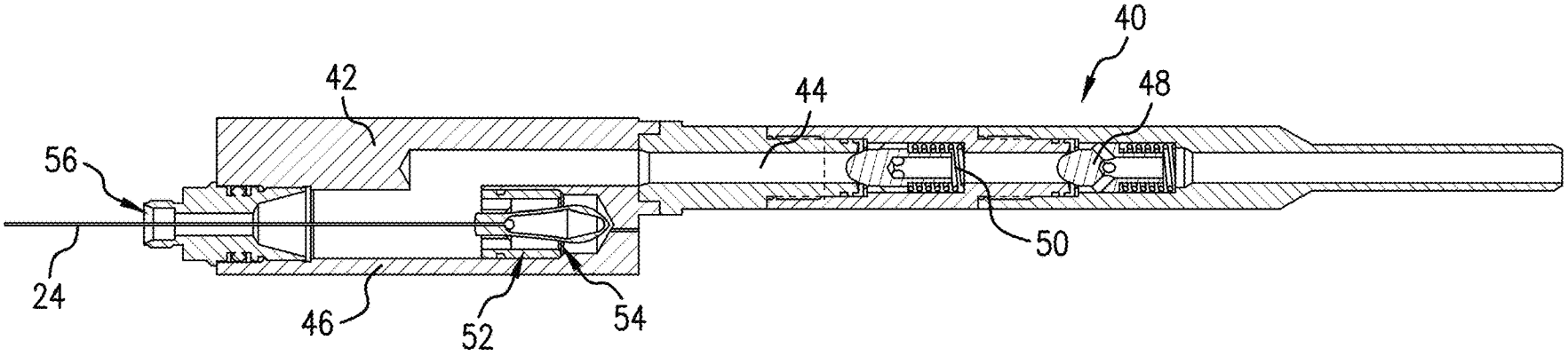
FIG. 3 is a sectional view of a chemical injection valve as disclosed herein.
Figure 4:
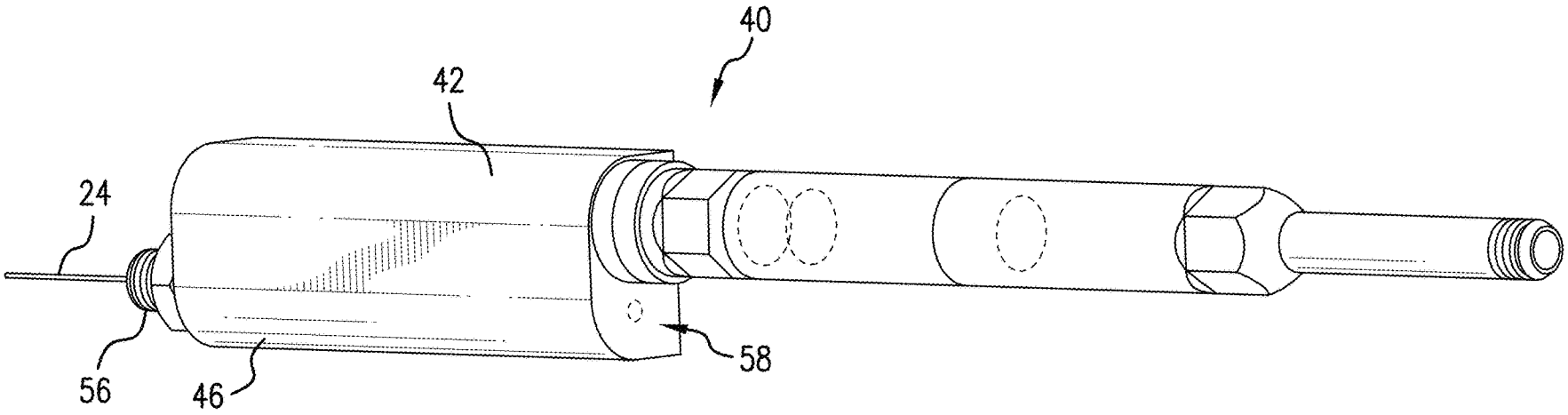
FIG. 4 is a perspective outside view of the valve as illustrated in FIG. 3.

In order to enhance functionality of system 10 where a new subsystem is being installed/run in the hole, a chemical injection valve 40 as illustrated in FIGS. 3 and 4 is employed. Valve 40 comprises a housing 42 having a flow section 44 and a side pocket section 46. The flow section includes a check valve 48 and may in some embodiments also include a burst disk 50. In the side pocket section 46, a landing nipple cartridge 52 is disposed that is configured to receive and secure a landing nipple 54 on the fiber 24. Cartridge 52 may be a mechanical cage type cartridge, a magnetic cartridge, a magnetically permeable cartridge, etc. providing it will receive and secure the landing nipple 54. Where the cartridge is magnetically permeable, the configuration would place a permanent magnet in the landing nipple 54. Where the cartridge 52 includes a magnet, the landing nipple 54 will include a magnetically permeable material. It is also contemplated that permanent magnets may be incorporated into each of the cartridge 52 and landing nipple 54 in a polar orientation to be attracted to one another. It will be evident that the landing nipple 54 must be of a dimension or of a compressibility to move through a control line inlet 56 of the valve 40. In some embodiments, a port 58 may be provided in the section 46 that is vented to the downhole environment to allow fluid used to convey the fiber 24 through fluid drag, to exit the side pocket and help to seat the landing nipple 54 in the cartridge 52. Valve 40 is usable for chemical injection only or to also receive the fiber 24 upon initial run or after.

Figure 5:
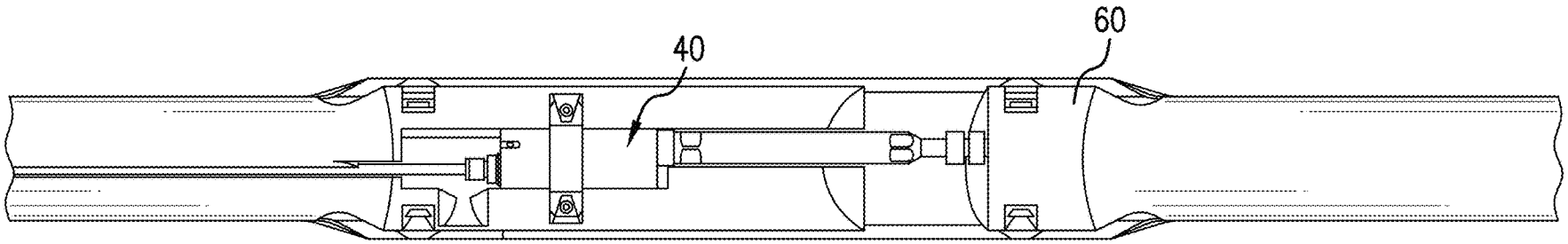
FIG. 5 is a side view of the valve of FIG. 4 secured to a portion of a string.

FIG. 5 illustrates the valve 40 disposed upon a portion of a string 60 for running in the hole in a secure and protected manner.

Individual portions of the foregoing disclosure have their own novelty and importance to the art but are also cumulatively quite valuable to the improved efficiency of a wellbore configured as illustrated and disclosed. Such a wellbore system includes the borehole 16 in the subsurface formation 18 and having the string 60 therein. The surface system 12 is disposed operably near the borehole 16 and includes both of the chemical or gas injection subsystem 20 and an optic fiber injection system 34 to a gas lift or chemical injection subsystem 20 in the borehole; and an optic fiber 24 disposed in the chemical or gas injection subsystem 20.

Set forth below are some embodiments of the foregoing disclosure:

Embodiment 1: A wellhead, including a wellhead housing, a fluid injection system disposed in the wellhead housing, a fiber injection system disposed in the wellhead housing and operably connected to the fluid injection system to inject fiber into the fluid injection system.

Embodiment 2: The wellhead as in any prior embodiment, wherein the fiber injection system includes a fiber header.

Embodiment 3: The wellhead as in any prior embodiment, wherein the fluid injection system is a chemical injection system.

Embodiment 4: The wellhead as in any prior embodiment, wherein the fluid injection system is a gas lift injection system.

Embodiment 5: A multimodal fluid injection valve, including a body having a check valve therein, a side pocket physically and fluidly connected to the body, the side pocket including a fiber anchor therein.

Embodiment 6: The valve as in any prior embodiment, wherein the body further includes a burst disk.

Embodiment 7: The valve as in any prior embodiment, wherein the fiber anchor includes a landing nipple cartridge.

Embodiment 8: The valve as in any prior embodiment, wherein the fiber anchor includes a magnetically permeable material.

Embodiment 9: The valve as in any prior embodiment, wherein the fiber anchor includes a magnet.

Embodiment 10: A method for instrumenting a preexisting gas lift or chemical injection system, including cleaning the chemical injection system, and injecting optic fiber through the chemical injection system.

Embodiment 11: The method as in any prior embodiment, wherein the cleaning is by fluid displacement.

Embodiment 12: A wellbore system including a borehole in a subsurface formation, a string in the borehole, a surface system operably connecting both a chemical or gas injection device and an optic fiber injection device to a gas lift or chemical injection subsystem in the borehole, and an optic fiber disposed in the chemical or gas injection subsystem.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A wellbore system, comprising:

a wellhead housing;

a fluid injection system operably connected to the wellhead housing;

a fiber injection system operably connected to the wellhead housing and operably connected to the fluid injection system to inject bare fiber into the fluid injection system; and a multimodal fluid injection valve, comprising:

a body having a check valve therein;

a side pocket entirely within the body, the side pocket including a fiber anchor comprising a landing nipple cartridge configured to receive a landing nipple that terminates an optic fiber.

2. The wellbore system as claimed in claim 1, wherein the fiber injection system includes a fiber header.

3. The wellbore system as claimed in claim 1, wherein the fluid injection system is a chemical injection system.

4. The wellbore system as claimed in claim 1, wherein the fluid injection system is a gas lift injection system.

5. A multimodal fluid injection valve, comprising:

a body having a check valve therein;

a side pocket entirely with the body the side pocket including a fiber anchor comprising a landing nipple cartridge configured to receive a landing nipple that terminates an optic fiber.

6. The valve as claimed in claim 5, wherein the body further includes a burst disk.

7. The valve as claimed in claim 5, wherein the fiber anchor includes a magnetically permeable material.

8. The valve as claimed in claim 5, wherein the fiber anchor includes a magnet.

9. A wellbore system comprising:

a borehole in a subsurface formation;

a string in the borehole;

a surface system operably connecting both a chemical or gas injection device and an optic fiber injection device to a gas lift or chemical injection subsystem in the borehole; and a bare optic fiber disposed in the chemical or gas injection subsystem; and a multimodal fluid injection valve, comprising:

a body having a check valve therein;

a side pocket entirely within the body, the side pocket including a fiber anchor comprising a landing nipple cartridge configured to receive a landing nipple that terminates an optic fiber.

* * * * *